United States Patent [19]

Dogliotti

[11] 3,976,193

[45] Aug. 24, 1976

[54] CONTAINER FOR HOLDING FLAT PARALLELIPIPEDIC ARTICLES

[75] Inventor: Amilcare Dogliotti, Neive (Cuneo), Italy

[73] Assignee: P. Ferrero & C. S.p.A., Alba (Cuneo), Italy

[22] Filed: Apr. 16, 1975

[21] Appl. No.: 568,760

[30] Foreign Application Priority Data

Nov. 20, 1974 Italy ..... 53611/74

[52] U.S. Cl. ..... 206/72; 220/20; 229/2.5 R

[51] Int. Cl.² ..... B65D 1/34; B65D 1/00; B65D 85/62

[58] Field of Search ..... 206/72, 203, 45.14; 229/15, 2.5; 220/20, 21, 22; 211/72

[56] References Cited

UNITED STATES PATENTS

| | | | |
|---|---|---|---|
| 2,758,750 | 8/1956 | Stroop | 229/15 |
| 2,821,327 | 1/1958 | Glazer | 206/203 |
| 2,851,188 | 9/1958 | Pavelle | 206/72 |
| 3,212,907 | 10/1965 | Caprioli | 229/2.5 |
| 3,273,700 | 9/1966 | Moreau et al. | 220/20 |
| 3,865,247 | 2/1975 | Neglia | 211/72 |

*Primary Examiner*—William T. Dixson, Jr.
*Attorney, Agent, or Firm*—Sughrue, Rothwell, Mion, Zinn & Macpeak

[57] ABSTRACT

The container is comprised of an open-top rectangular compartment of lightweight plastic material. The side walls of the compartment parallel to the longer dimension are each provide with a plurality of equally spaced inwardly facing ribs to aid in supporting articles located in said compartments. Two such compartments may be integrally connected in side by side relation along a common longitudinal edge between the compartments.

1 Claim, 4 Drawing Figures

CONTAINER FOR HOLDING FLAT PARALLELIPIPEDIC ARTICLES

BACKGROUND OF THE INVENTION

Field of the Invention

The present invention relates to the production of a container for holding a plurality of flat parallelipipedic articles such as containers of lozenges, and the like in a row parallel to each other. This container is intended to be simple and inexpensive to produce as well as practical and easy to use. The container having a plurality of said articles pre-packaged therein can then be inserted rapidly in a column-type display stand having chambers therein complementary to the containers.

SUMMARY OF THE INVENTION

The main feature of the container according to the invention is that it is in the form of a rectangular thin-walled compartment having a transverse dimension corresponding to the width of the articles and longitudinal dimension corresponding to a multiple of the thickness of the articles. The two longer opposite walls of the compartment are provided with vertical ribs defining the spaces for the individual articles.

Other objects, features and advantages of the present invention will be made apparent in the following detailed description thereof which is provided with reference to the accompanying drawings.

DESCRIPTION OF THE PREFERRED EMBODIMENT

The container 1 for holding flat parallelipipedic articles according to the invention consists of a thin-walled compartment, preferably heat-molded from plastics material. The chamber is rectangular in shape with a transverse dimension equal to the width of the articles 3 to be packed and a longitudinal dimension equal to a multiple of the thickness of the articles. The longitudinal dimension may vary according to the number of articles to be packed in one compartment. The two longer opposite walls of the compartment are provided with vertical ribs 2 delimiting or defining the spaces intended for the individual articles and holding the articles in an upright position.

Figure 1:
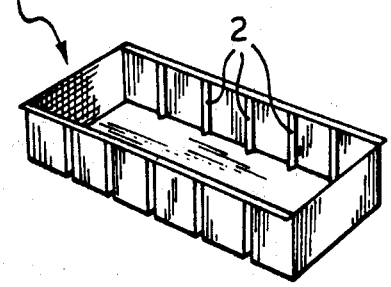
FIG. 1 is a perspective view of a container for holding articles according to the present invention.
Figure 2:
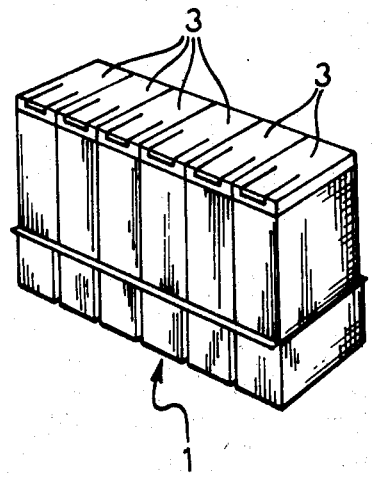
FIG. 2 is a perspective view of a container holding the packed articles.
Figure 3:
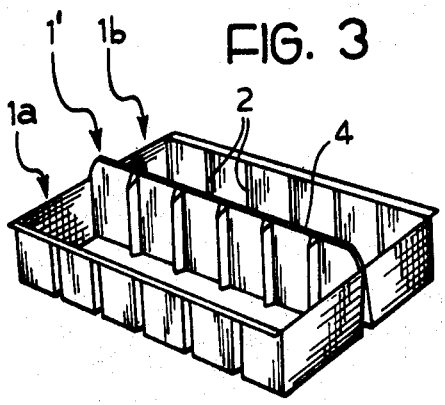
FIG. 3 is a perspective view of a multiple container.
Figure 4:
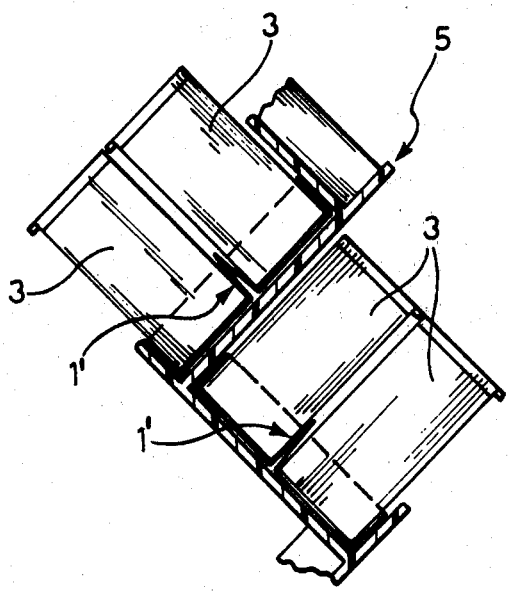
FIG. 4 is a transverse sectional view showing the containers inserted in a display stand.

FIG. 3 shows a container 1' consisting of two adjacent compartments 1*a* and 1*b*, having a common integral edge 4 connecting the two adjacent walls. The two compartments 1*a* and 1*b* are produced in one piece from plastics material and employ the same system for packing double the number of articles. The above-described container is advantageously used to facilitate the loading of column-type display stands 5 such as the one partially shown in FIG. 4. The retaining action exerted by the vertical ribs 2 on the articles 3 makes it possible to arrange the containers in a sharply inclined position, as shown in FIG. 4, without any risk of the articles falling out accidentally or falling sideways when an adjacent article is removed.

While the invention has been particularly shown and described with reference to preferred embodiments thereof, it will be understood by those in the art that the foregoing and other changes in form and details may be made therein without departing from the spirit and scope of the invention.

What is claimed is:

1. A prepackaged container for use in a display stand having at least one compartment for closely receiving said container comprising a pair of rectilinear compartments each of which has two long sides, two short sides and a bottom and a plurality of flat parallelipipedic articles disposed side by side in each compartment to completely fill each compartment, said container being constructed in one piece from thin flexible plastic material with the two short sides and the bottom of each compartment being substantially smooth and flat with the two long sides of each compartment being formed with vertically extending spaced apart corrugations providing a plurality of spaced apart ribs on the inside surfaces of said long walls, said ribs being located between adjacent articles for holding said articles in upright position in said compartment in the absence of one or more articles from the row in said compartment, said compartments being disposed side by side with only the top edges of two adjacent long sides being integrally joined by a narrow strip of said thin flexible material.

* * * * *